US009731336B2

(12) United States Patent
Peltoniemi et al.

(10) Patent No.: US 9,731,336 B2
(45) Date of Patent: Aug. 15, 2017

(54) METHOD FOR PRODUCING SEAMLESS PIPES

(75) Inventors: Raimo Peltoniemi, Cambridge (CA); Daniel Peltoniemi, Cambridge (CA)

(73) Assignee: COATING MANAGEMENT SWITZERLAND GMBH, Zug (CH)

( * ) Notice: Subject to any disclaimer, the term of this patent is extended or adjusted under 35 U.S.C. 154(b) by 66 days.

(21) Appl. No.: 13/698,130

(22) PCT Filed: Jun. 8, 2011

(86) PCT No.: PCT/EP2011/002811

§ 371 (c)(1),
(2), (4) Date: Dec. 14, 2012

(87) PCT Pub. No.: WO2011/154133

PCT Pub. Date: Dec. 15, 2011

(65) Prior Publication Data

US 2013/0091916 A1 Apr. 18, 2013

Related U.S. Application Data

(60) Provisional application No. 61/352,443, filed on Jun. 8, 2010.

(51) Int. Cl.

| | |
|---|---|
| ***B21B 19/04*** | (2006.01) |
| ***B21B 15/00*** | (2006.01) |
| ***B21B 23/00*** | (2006.01) |
| *B21B 25/00* | (2006.01) |

(52) U.S. Cl.

CPC ..... *B21B 15/00* (2013.01); *B21B 19/04* (2013.01); *B21B 23/00* (2013.01); *B21B 25/00* (2013.01)

(58) Field of Classification Search

CPC ..... B21B 17/10; B21B 17/02; B21B 19/04; B21B 45/02; B21B 17/08; B21B 9/00; B21B 25/00; B21B 25/04; B21B 13/00

USPC ..... 72/38, 39, 41–46, 67, 69, 96, 97, 127, 72/150, 199, 201, 208, 209, 236, 251, 72/252, 343, 361, 362, 370, 462, 465

See application file for complete search history.

(56) References Cited

U.S. PATENT DOCUMENTS

| | | | | |
|---|---|---|---|---|
| 3,577,754 | A | 5/1971 | Calmes | |
| 4,404,828 | A * | 9/1983 | Blachford | 72/42 |
| 5,016,456 | A | 5/1991 | Furrer et al. | |
| 6,605,304 | B1 * | 8/2003 | Wellinghoff et al. | 424/489 |
| 7,308,812 | B2 | 12/2007 | Iida et al. | |
| 8,464,565 | B2 | 6/2013 | Hiraishi | |
| 2007/0157691 | A1 * | 7/2007 | Iida et al. | 72/41 |
| 2007/0214855 | A1 * | 9/2007 | Hiraishi | 72/69 |

(Continued)

FOREIGN PATENT DOCUMENTS

| | | | |
|---|---|---|---|
| DE | 19604969 | A | 8/1997 |
| EP | 1872878 | A1 | 1/2008 |

(Continued)

*Primary Examiner* — Debra Sullivan
(74) *Attorney, Agent, or Firm* — Andrew Wilford

(57) ABSTRACT

The invention relates to a method for producing seamless pipes of heated massive metal blocks, by means of a mandrel (4), which is fastened on a rolling rod (5), in the case of which a coating material is applied onto the inner side of the hollow block (3) during the forming process by means of the influence of the rolling rod (5) from the massive metal block to a hollow block (3), which is created during the forming.

12 Claims, 1 Drawing Sheet

(56) References Cited

U.S. PATENT DOCUMENTS

| | | | | |
|---|---|---|---|---|
| 2009/0301151 | A1* | 12/2009 | Shimoda | C10M 173/02 72/42 |
| 2009/0308125 | A1 | 12/2009 | Yamane | |
| 2012/0210761 | A1* | 8/2012 | Higashida et al. | 72/43 |
| 2012/0323035 | A1 | 12/2012 | Bouix-Peter et al. | |

FOREIGN PATENT DOCUMENTS

| | | | | |
|---|---|---|---|---|
| JP | 55112108 | A | 8/1980 | |
| JP | 619085 | B2 * | 3/1986 | B21B 25/04 72/39 |
| JP | 61137613 | A | 6/1986 | |
| JP | 61137613 | B | 6/1986 | |
| JP | 63154207 | B | 6/1988 | |
| JP | 02224805 | A | 9/1990 | |
| WO | 91/01824 | A1 | 2/1991 | |
| WO | 9101824 | A | 2/1991 | |

* cited by examiner

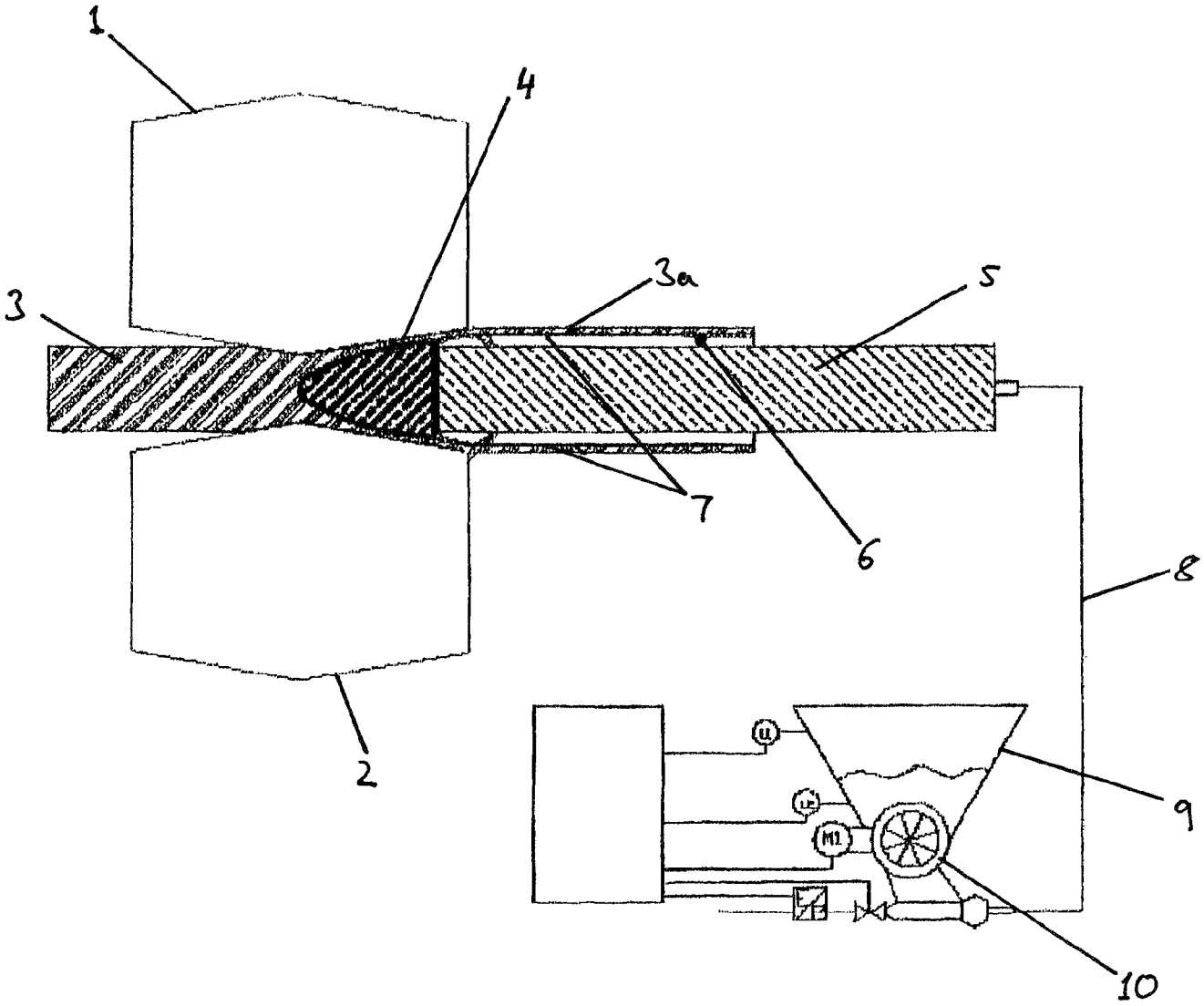
1
2
3
3a
4
5
6
7
8
9
10

METHOD FOR PRODUCING SEAMLESS PIPES

CROSS REFERENCE TO RELATED APPLICATIONS

This application is the US-national stage of PCT application PCT/EP2011/002811 filed Jun. 8, 2011, published Dec. 15, 2011 as WO2011/154133, and claiming the priority of U.S. provisional application Ser. No. 61/352,443 itself filed Jun. 8, 2010.

FIELD OF THE INVENTION

The invention relates to a method of making seamless pipes of heated solid metal blocks, in particular comprising a cross-rolling mill in which the block is driven by the rollers that are set at an angle, and is rolled via an inner tool that consists of a mandrel that is fastened on a rolling rod so as to be capable of being detached, if necessary.

BACKGROUND OF THE INVENTION

During the rolling, the rolling rod thereby supports itself against a mandrel thrust block with its end that faces away from the mandrel. A solid and mostly round metal block that is heated to rolling heat, is pierced and is stretched in the further process to form a seamless pipe. The hole is hereby created in that the round block is driven by the rollers that are set at an angle, and is rolled via a mandrel. It is thereby the object of the mandrel to pierce the core zone of the block, to smooth the inner surface of the created hollow block and to bring the wall thickness thereof to the desired measure.

Such a method as well as a device for carrying out the method is known from DE 1 96 04 969 C2, for example. This publication deals in particular with the wear of the forming tools and the necessity to cool them as well with the impact of the coolant on the rolling stock itself.

When the heated metal block is in contact with the atmospheric oxygen or oxygen from other sources, such as the cooling water, for instance, scale, which must ideally be detached prior to the further forming, but no later than during the forming so as to prevent surface errors at the inner surface of the finally created seamless pipe, are created at the inner surface of the hollow block and also in deforming steps that follow the first forming process, if necessary.

Prior to the further forming of the hollow block into a seamless pipe, the method that is typically used for this provides for the blow-off of already loosened scale by nitrogen or air as is well as for the subsequent introduction of borate-containing powders, such as borax, for example. For the most part, this borax melts on the surface of the hollow block, loosens the scale to the extent that it can be blown out of the interior of the hollow block reliably and converts the scale into a liquid form. The introduction of the borate-containing powders takes 4 to 10 seconds. Finally, the discharge, which may be necessary, of the scale that has been softened, liquefied or loosened by the borate-containing powder, requires an additional 1 to 8 seconds.

The methods known from the state of the art thus not only result in an undesired delay of the production process as a whole, but also to a considerable discharge of borax and the burn-off thereof into the environment, due to the use of typically approximately 2 kg of borax for each ton of rolling stock. Finally, the temperature of the hollow block is also lowered in an undesirable manner by this method step that was required until now.

To overcome the interfering influences of the mill scale downstream from the piercing process, JP 63-154207A additionally proposes the introduction of a lubricant made of graphite into the area between an elongator mandrel and the inner surface of the hollow block. The formation of scale, however, is not significantly prevented by this.

OBJECT OF THE INVENTION

Based on the above-discussed state of the art, it was thus the object of the invention to provide a method of making seamless pipes that is able to reliably prevent the disadvantages known from the state of the art. In terms of the invention, this object is solved by a method in which a coating material is applied to the inner surface of the hollow block during the forming process by the rolling rod from the solid metal block to a hollow block.

SUMMARY OF THE INVENTION

The invention is based on the discovery that the formation of scale on the inner surface of the hollow block and, if necessary, also on the inner surface of the seamless pipe that is later created from the hollow block, can then be prevented reliably when a coating material (so-called "Piercer Shell Inner Surface Treatment Product" or "Product" in short) is applied onto the inner surface of the hollow block already during the forming process under the influence of the mandrel on the solid metal block and during the entire piercing process.

The formation of scale can be slowed down effectively, if not prevented completely by the preferably complete coating of the inner surface of the hollow block. In terms of the invention, it is made possible through this to completely do without the step of loosening scale and the discharge thereof from the formed hollow block, if necessary, without having to accept disadvantages with reference to the quality of the inner surface of the hollow block.

The use of borate-containing substances and the discharge thereof into the environment can furthermore be limited to a minimum and can be prevented completely, if necessary. When using borax as a component of the coating material, the material usage and consequently also the discharge thereof into the environment is only 10-20% as compared to the above-defined standard methods, due to the required quantities that are considerably smaller.

The invention is thus geared to reliably prevent the contact of the inner surface of the hollow block with oxygen, in particular the atmospheric oxygen. However, in a particularly advantageous alternative of the method according to the invention, an inert gas, preferably nitrogen, is used to displace the air within the hollow block and/or the seamless pipe. This can take place, for example, in that inert gas is guided into the interior of the hollow block together with the coating material and via the same lines and openings.

However, an embodiment of the method according to the invention is also preferred in which the inert gas, preferably nitrogen, is supplied via separate lines ad openings, whereby an uncoupling of nitrogen supply and coating material supply is attained.

Finally, an embodiment is also preferred in which the inert gas, preferably nitrogen, is supplied together with the coating material, and the nitrogen is additionally supplied to any location in the interior of the hollow block, if necessary, via separate lines and/or separate openings.

It is preferred when the coating material is applied onto the inner surface of the hollow block at least almost immediately after the loosening of the inner surface of the hollow block from the mandrel. The idea of the invention thus also comprises methods in which coating material is already introduced between the mandrel and the hollow block, even before the inner surface of the hollow block lifts itself from the mandrel, due to the shape of the mandrel, and causes the advance of the block against the mandrel. A contact of the oxygen with the inner surface of the hollow block can be completely prevented through this.

However, a method in which the coating material is only applied after the loosening of the inner surface of the hollow block from the mandrel, is also preferred. It goes without saying that the application of the coating material should take place as soon as possible in such a case, so that the formation of scale remains limited to a minimum that is considered to be acceptable.

For the application of the coating material in the above-specified manner, it is preferred when openings in the mandrel and/or the rolling rod itself are attached such that the coating material can be applied to the inner surface of the hollow block via these openings. A plurality of openings that are arranged across the periphery of the tool, preferably in an equidistant manner, are hereby particularly preferred, so as to secure a complete and preferably even distribution of the coating material on the inner surface of the hollow block through this in cooperation with the rotation of mandrel and/or rolling rod relative to the hollow block.

Only a small number of minimum demands must be made on the coating material itself. It must be ensured that after the contact with the inner surface of the hollow block, this coating material adheres at least to the extent that a coating is created, through which the formation of scale is attained at least considerably, preferably by at least 50%, more preferably by at least 80% as compared to the above-defined standard methods. For this, the formation of a continuous coating film comprising a minimum thickness of at least 1 μm is currently considered to be advantageous.

A method in which the coating material embodies an air-impermeable cover layer on the inner surface of the hollow block as well as on the inner surface of the seamless pipe, is particularly preferred. It is extremely preferred hereby when the cover layer on the inner surface of the hollow block has a thickness of less than 100 μm, particularly preferably of less than 10 m on average. It is ensured through this that the contact of the inner surface of the hollow block with the atmospheric oxygen that may be present, or other oxygen that enters into the process steps, is prevented reliably.

In a preferred embodiment of the method according to the invention, the coating material is applied onto the inner surface of the hollow block in powder form by a carrier gas. Particularly preferably, pipelines that lead to the opening through the rolling rod and possibly also through the mandrel, are used for this, so as to reliably ensure the application of the coating material onto the inner surface of the hollow block through this. It is particularly preferred hereby when the mixture of carrier gas and coating material is introduced into the line at a pressure of less than 20 bar, but preferably 1-5 bar, so as to ensure a sufficient pressure at the openings through this.

It is particularly preferred when the grain size of at least 90% of the powder is less than 840 μm, preferably less than 250 μm and more preferably between 30 and 50 μm. It is ensured through this that no blockages are to be feared within the supply pipes or openings within the rolling rod or the mandrel, and that the formation of a continuous coating film comprising such grain sizes is supported in a particularly advantageous manner.

In an alternative and likewise preferred embodiment of the method according to the invention, the application of the coating material, however, takes place in liquid form, preferably as a powder that is dissolved in water and/or mixed with water. Through this, the supply of the coating material onto the inner surface of the hollow block through the rolling rod and the mandrel is designed so as to be particularly simple. Furthermore, the liquid form of the supply of the coating material also supports the formation of the coating film on the inner surface of the hollow block in a particularly advantageous manner.

In a particularly preferred embodiment of this alternative of the method according to the invention, the volume fraction of the liquid, preferably of water, is 60-90% in the mixture or solution. It is furthermore particularly preferred when the coating material is supplied through the lines in liquid form at a pressure of 5-50 bar, more preferably 10-25 bar.

Provided that it is to contain borax, the coating material either consists of a mixture of borax and Sodium Tripolyphosphate (NaTTP), preferably together with soap and/or mica, or of borax and sodium sulfates, preferably by adding graphite. The individual, preferred portions of the respective components, in each case specified in percent by weight, are specified in the following table 1 together with the information with regard to the effect for the individual components.

As to the mica, this is understood to be silicates, particularly layered silicates, having the general chemical formula $DG_2$,3[T Oio]X2 where D means 12-coordinated cations (K, Na, Ca, Ba, Rb, Cs, $NH^{4+}$), G means 6-coordinated cations (Li, Mg, $Fe^{2+}$, Mn, Zn, Al, $Fe^{3+}$, Cr, V, Ti), T means 4-coordinated cations (Si, Al, $Fe^{3+}$, B, Be) and X means anions (OH\$F^-$, $S^{2-}$).

According to the invention, mica having sodium and/or potassium as well as calcium and/or barium and silicon and/or aluminum and/or iron and/or titanium as the main components are preferred.

TABLE 1

| No. | Component | Portion in the Mixture % | Purpose |
|---|---|---|---|
| 1 | soap | 0-10 | wetting |
| | borax | 52-80 | scale loosening |
| | NaTTP | 20-40 | scale loosening + surface coverage |
| | mica | 0-20 | lubrication |
| 2 | graphite | 0-35 | lubrication |
| | borax | 25-65 | scale loosening |
| | sodium sulfates | 20-60 | wetting + surface coverage |

In the event that the coating material, however, is to be completely free from borate, which is particularly preferred, the mixture for the coating material consists substantially of Sodium Tripolyphosphate (NaTTP) and Sodium N-metaphosphate, preferably Phoskadent M®, in which the main component consists of Sodium dimetaphosphate, to which graphite is also added in a particularly advantageous manner. The individual portions for the percent by weight that are in each case specified for the components, are specified in the below-specified table 2 together with the effects of the individual components.

TABLE 2

| Component | Portion in the Mixture % | Purpose |
|---|---|---|
| graphite | 0-10 | lubrication |
| NaTTP | 20-50 | scale loosening + surface coverage |
| Phoskadent M ® | 10-56 | scale loosening + coverage |

It can be seen through this that the coating material according to the invention must not necessarily render a lubricating effect, even if this can indeed be considered to be advantageous. In particular, the lubricating effect of a suitably composed coating film for subsequent process steps, in particular the production of the seamless pipe from the hollow block, can be useful.

A method in which the coating film remains in the hollow block once it has been applied during the production of the hollow blocks, and reliably prevents the appearance of scale in the entire production process for seamless pipes.

BRIEF DESCRIPTION OF THE DRAWING

The invention will be defined in detail below with reference to the drawing whose sole figure is a schematic view of a device for the supply of nitrogen through the rolling rod and for the supply of coating material through the rolling rod. The coating material is applied by a PLC-controlled application system using an adjustable metering device.

DETAILED DESCRIPTION OF THE INVENTION

The drawing schematically shows a piercing mill in which a block 3 is driven between an upper roller 1 set at an angle, and a lower roller 2 set at an angle against a mandrel 4 fixed to a rolling rod 5 so as to be capable of being detached. The forming of a solid metal block 3 into a hollow block 3*a* takes place hereby viewed from left to right in the figure, wherein the hollow block shell 3*a* separates from the mandrel 4 in the forming process and forms an air gap between the rolling rod 5 and the inner surface 6 of the hollow block 3*a*.

According to the invention, coating material is fed from a coating material supply 9 via a metering device 10 and a supply line 8 for the coating material through the rolling rod 5 and the mandrel 4, if necessary, to the inner surface 6 of the hollow block 3*a* so as to effect a complete sealing of the inner surface 6 of the hollow block 3*a* in this manner. The powdery coating material is applied onto the inner face 6 of the hollow block 3*a* together with nitrogen in a controlled manner at a pressure of 1-5 bar through the supply line 8 and the rolling rod 5. The atmospheric oxygen is already replace almost completely by the nitrogen in the hollow block 3 by the excess of nitrogen that does not react with the red-hot metal of the hollow block 3 and that has been introduced through the rolling rod 5 and contacted with the inner face 6 of the hollow block 3*a*. If necessary, additional nitrogen can be added into the interior of the hollow block 3 via further unillustrated supply lines.

The invention claimed is:

1. A method of making seamless pipe comprising the steps of:

piercing a massive heated metal block with a mandrel fixed to a rolling rod to form in the block a through-going hole having an inner surface; and during the piercing and prior to formation of scale on the inner surface, feeding a scale-inhibiting coating material to the inner surface of the hollow block through the mandrel so as to coat the surface and prevent the formation of scale, the scale-inhibiting coating material being a mixture with water of sodium tripolyphosphate and sodium N-metaphosphate free from borate together with graphite.

2. The method defined in claim 1, further comprising the step after piercing the block of:

separating the inner surface of the block from the mandrel; and commencing application of the scale-inhibiting coating material to the inner surface of the hollow block immediately after the separation of the inner surface of the hollow block from the mandrel.

3. The method defined in claim 1, wherein the scale-inhibiting coating material is applied to the inner surface of the hollow block through openings in the mandrel or in the rolling rod.

4. The method defined in claim 1, wherein the scale-inhibiting coating material is composed so as to form an air-impermeable cover layer on the inner surface of the hollow block.

5. A The method of defined in claims 1, wherein the cover layer on the inner surface of the hollow block has a thickness of less than 100 μm on average.

6. The method defined in claim 1, further comprising the step of:

feeding inert gas through the rod and/or the mandrel into the hollow block during piercing.

7. The method defined in claim 1, wherein the scale-inhibiting coating material is a powder, the method further comprising the step of:

conveying the powder to the inner surface of the hollow block as a powder solution or mixture with water.

8. The method defined in claim 7, wherein the water is 60-90% by volume of the mixture or solution.

9. The method defined in claim 1, further comprising the step of:

supplying the liquid scale-inhibiting coating material at a pressure of 3 to 40 bar.

10. A method of making seamless pipe comprising the steps of:

piercing a massive heated metal block with a mandrel fixed to a rolling rod to form in the block a through-going hole having an inner surface;

during the piercing and prior to formation of scale on the inner surface, feeding a powdered scale-inhibiting coating material to the inner surface of the hollow block through the mandrel so as to coat the surface and prevent the formation of scale;

conveying the powdered scale-inhibiting coating to the inner surface of the hollow block with a carrier gas; and pressurizing the carrier gas to a pressure of less than 20 bar.

11. The method defined in claim 10, wherein a particle size of at least 90% of the powdered scale-inhibiting coating material is less than 840 μm.

12. A method of making seamless pipe comprising the steps of:

piercing a massive heated metal block with a mandrel fixed to a rolling rod to form in the block a through-going hole having an inner surface;

making a mixture with water of a) borax and sodium tripolyphosphate together with soap and mica, or b) borax and sodium sulfates together with graphite; and during the piercing and prior to formation of scale on the inner surface, feeding the mixture to the inner surface of the hollow block through the mandrel so as to coat the surface and prevent the formation of scale.

* * * * *